United States Patent [19]

Kitatani et al.

[11] Patent Number: 4,614,699

[45] Date of Patent: Sep. 30, 1986

[54] LIQUID DEVELOPERS FOR ELECTROSTATIC IMAGES

[75] Inventors: Katsugi Kitatani; Masataka Murata; Hiroaki Yokoya; Nobuo Suzuki, all of Kanagawa, Japan

[73] Assignee: Fuji Photo Film Co., Ltd., Kanagawa, Japan

[21] Appl. No.: 631,114

[22] Filed: Jul. 16, 1984

[30] Foreign Application Priority Data

Jul. 14, 1983 [JP] Japan ..... 58-128227

[51] Int. Cl.[4] ..... G03G 9/02

[52] U.S. Cl. ..... 430/115

[58] Field of Search ..... 430/115

[56] References Cited

U.S. PATENT DOCUMENTS

| | | | |
|---|---|---|---|
| 2,892,794 | 6/1959 | Insalaco | 430/110 X |
| 3,826,747 | 7/1974 | Nagashima et al. | 430/115 |
| 4,206,064 | 3/1980 | Kinchi et al. | 430/115 X |

FOREIGN PATENT DOCUMENTS

| | | | |
|---|---|---|---|
| 47-8756 | of 1972 | Japan | 430/115 |

*Primary Examiner*—John D. Welsh

*Attorney, Agent, or Firm*—Sughrue, Mion, Zinn, Macpeak, and Seas

[57] ABSTRACT

A liquid developer for electrostatic images which comprises at least one charge controlling agent selected from the group consisting of compounds represented by formula (I) or (II) and complex salts containing a molecular structure shown by the formula (I) or (II):

(I)

(II)

wherein $R^1$ and $R^2$ each represents a hydrogen atom, an alkyl and substituted alkyl group, an aryl and a substituted aryl group, an aralkyl group, an aliphatic acyl group, an aromatic acyl group, an alkylsulfonyl group, an arylsulfonyl group, $R^1$ and $R^2$ represent identical group or different groups, or $R^1$ and $R^2$ together form a heterocyclic ring with the nitrogen atom in the formulae, and when one of $R^1$ and $R^2$ represents a hydrogen atom, the other represents a group other than a hydrogen atom;

A represents an alkylene group or a substituted alkylene group;

X represents a hydrogen atom, a monovalent to tetravalent metal atom, a quaternary ammonium cation, and n represents a positive integer of 1 to 4, and when X represents the metal atom defined above and the number represented by n is not sufficient to satisfy the valence of the metal atom represented by X, the residual metal valence bond or bonds are occupied with one or more ligands to form the complex salt.

21 Claims, 2 Drawing Figures

LIQUID DEVELOPERS FOR ELECTROSTATIC IMAGES

FIELD OF THE INVENTION

The present invention relates to control of charges of liquid developers used for developing electrostatic images.

BACKGROUND OF THE INVENTION

Hitherto, liquid developers used for developing electrostatic images have been prepared by dispersing a coloring agent such as carbon black or Nigrosine, etc., a resin for forming toner particles which contributes to control of electric charges or acceleration of dispersion of toner particles by adsorbing in or covering the coloring agent, and, further, to improvement of fixation of images after development, a substance which dissolves in or swells by a liquid carrier to increase dispersion stability of toner particles and a substance which is able to increase the amount of electric charges and stabilizes electric charges on the toner particles, in a liquid carrier having a high electric resistance ($10^9$ to $10^{15}\Omega\cdot$cm).

Since electric charges on toner particles have a large influence upon images obtained by development processing, many efforts have been made to stably control them. At the present moment, processes roughly divided into two types have been known.

The first process comprises covering the surface of toner particles with a substance which is ionized or is capable of carrying out adsorption of ions. As substances used for such a purpose, there are oils such as linseed oil or soybean oil, etc., alkyd resins, halogenated polymers, aromatic polycarboxylic acids described in Japanese Patent Publication No. 5944/76, acid group-containing water-soluble dyes described in Japanese Patent Publication No. 12869/81 and aromatic polyamine oxidized condensates described in Japanese Patent Application (OPI) No. 12062/75 (the term "OPI" as used herein refers to a "published unexamined Japanese patent application"), etc. According to this process, since toner particles have polar groups themselves, it is possible to reduce the amount of ion components in the liquid carrier, and, thus, it is possible to produce developers having excellent development characteristics. However, there are problems, in that fine control of the charge is somewhat difficult, and the amount of charge is greatly reduced by the passage of time, depending upon the particular substances used. Further, particles containing such polar groups in a large amount are generally difficult to disperse, because of having a high cohesive force, and it is necessary to do a special device as shown in Japanese Patent Application (OPI) No. 31739/79.

The second process comprises using a substance capable of dissolving in a liquid carrier to carry out transfer of ions between it and toner particles. Known substances for this purpose include metal soaps such as cobalt naphthenate, nickel naphthenate or cobalt 2-ethylhexanate, etc., metal salts of sulfonic acids such as calcium dodecylbenzenesulfonate, metal salts of petroleum type sulfonic acids or metal salts of sulfosuccinic acid esters, etc., lecithin, polyvinyl pyrrolidone resins, polyamide resins, sulfonic acid containing resins described in Japanese Patent Publication No. 24944/81, and hydroxybenzoic acid derivatives described in Japanese Patent Application (OPI) No. 139753/82, etc.

The second process has been widely used, because addition of the charge controlling substance is easily carried out, and fine control of the charge can be carried out in this way. However, the electric resistance of the developer tends to be reduced thereby, because a substance easily ionizing is generally added. Consequently, the optimum amount added is subjected to very narrow restrictions. If the amount is above the appropriate amount, adverse influences, such as smearing of images or reduction of copy density, etc., tend to occur. Further, in the case of continuously producing numbers of copies, there is a problem in that the so-called fatigue of the developer occurs by accumulation of the charge controlling agent, resulting in deterioration of image density or resolving power. Further, some substances cause deterioration by oxidation, etc., during preservation and lose their charge controlling function.

The present inventors have paid our attention to the second type process. As a result of extensive searching to find ionic substances which dissociate properly in liquid carriers and which are stable with the passage of time, the present invention has been accomplished.

SUMMARY OF THE INVENTION

The first object of the present invention is to provide a liquid developer for electrostatic images containing a charge controlling agent having a wide allowable range of addition amounts.

The second object of the present invention is to provide a liquid developer having good stability of electric charges on toner particles with the passage of time, which cause less fatigue by repeated use.

The third object of the present invention is to provide a liquid developer for electrostatic images containing a charge controlling agent which do not damage dispersion stability of toners or fixing property, etc.

The liquid developer for electrostatic images of the present invention comprises at least one charge controlling agent selected from the group consisting of compounds represented by the following general formula (I) or (II) and complex salts containing a molecular structure shown by the formula (I) or (II):

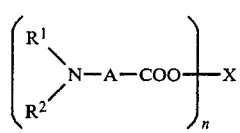

(I)

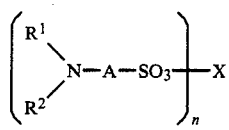

(II)

wherein $R^1$ and $R^2$ each represents a hydrogen atom, an alkyl and substituted alkyl group, an aryl and a substituted aryl group, an aralkyl group, an aliphatic acyl group, an aromatic acyl group, an alkyl sulfonyl group, an aryl sulfonyl group, $R^1$ and $R^2$ may be identical or different each other or $R^1$ and $R^2$ together may form a heterocyclic ring with the nitrogen atom in the formulae, and when one of $R^1$ and $R^2$ represents a hydrogen atom, the other represents a group other than a hydrogen atom;

A represents an alkylene group or a substituted alkylene group;

X represents a hydrogen atom, a monovalent to tetravalent metal atom, a quaternary ammonium cation; and n represents a positive integer of 1 to 4, and when X represents the metal atom defined above and the number represented by n is not sufficient to satisfy the valence of the metal atom represented by X, the residual metal valence bond or bonds are occupied with one or more ligands to form a complex salt containing a molecular structure shown by the formula (I) or (II).

DETAILED DESCRIPTION OF THE INVENTION

Figure 1:
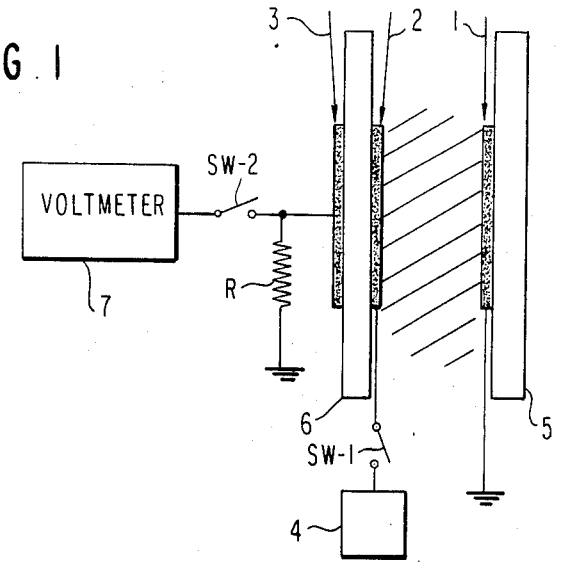
FIG. 1 is a schematic representation of an apparatus for measuring the amount of electric charge.

Examples of charge controlling agents of the present invention include substance shown below.

(i) Compounds represented by the formulae (I) and (II) wherein the valence of X is the same as the number represented by n.

(ii) Complex salts represented by the formula (I) or (II) wherein X is a metal and the number represented by n does not show a sufficent number of acid residue of formula (I) or (II) to satisfy the valence of the metal, and the residual valence bond or bonds of the metal are occupied by one or more ligands to form complex salts containing a molecular structure shown by the formula (I) or (II).

(iii) Reaction mixture for producing a salt disclosed in (i) and a complex salt disclosed in (ii), which contains an inorganic or organic metal salt and a compound represented by the formula (III) or (IV) which are used as starting materials:

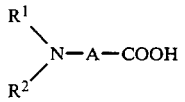

(III)

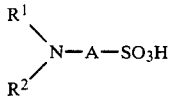

(IV)

wherein $R^1$, $R^2$ and A are defined as defined hereinabove.

Although not fully understood, the charge controlling mechanism may be theoretically explained based on the following discussion.

In the formulae (I) and (II), substituents $R^1$ and $R^2$ improve the oil solubility property of the compound to promote dissolution in the carrier liquid, and the nitrogen atom accelerates preferable ion dissociation as follows. In order that the carrier liquid-soluble charge controlling agent shows an effect, it is necessary that it causes ion dissociation in a nonpolar solvent and one of the dissociated ions is selectively adsorbed on the surface of toner particles. Alternatively, it is necessary to ionize itself by depriving ions on the surface of toner particles. For example, in the case of formula (I), it is believed that ionization is accelerated because the nitrogen atom having a coordinating ability to the cation is present in a suitable position in the molecule as shown in the following formula (I'), and the formed cation is stably dissolved in the liquid carrier by the effect of $R^1$ and $R^2$.

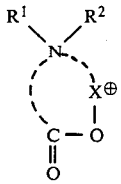

(I')

As a result, it is believed that toner particles are negatively charged by adsorbing the counter ion which has relatively inferior solubility.

On the other hand, in the case that a polymer having amino groups, etc., which easily adsorb cations, is introduced into the toner particles, it is believed that selective adsorption of the cation occurs and the toner particles are positively charged. Although the detailed reason why unsuitable dissociation in the liquid carrier is restricted is not clear at present, it is believed that the compounds of the present invention take the effect without using a large concentration which causes such dissociation.

Examples of useful ligands include halogens such as F, Cl, Br and I, a hydroxyl group, an oxygen atom, water, ammonia, amines, phosphines and sulfides, etc. Examples of amines, phosphines and sulfides include compounds represented by the formulae

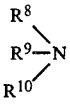

(V)

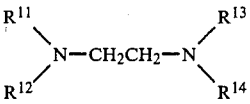

(VI)

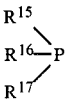

(VII)

and

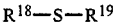

(VIII)

wherein $R^8$, $R^9$, $R^{10}$, $R^{11}$, $R^{12}$, $R^{13}$, $R^{14}$, $R^{15}$, $R^{16}$, $R^{17}$, $R^{18}$ and $R^{19}$ each represents a hydrogen atom, an alkyl group having preferably 1 to 18 carbon atoms or an aryl group having preferably 6 to 24 carbon atoms. $R^8$ to $R^{19}$ each may represent the same or different groups but in each formula $R^{15}$, $R^{16}$ and $R^{17}$, $R^{18}$ and $R^{19}$ do not represent hydrogen atoms at the same time. Furthermore, in each combination of two groups among $R^8$ to $R^{10}$, $R^{11}$ and $R^{12}$, $R^{13}$ and $R^{14}$, two groups among $R^{15}$ to $R^{17}$, and $R^{18}$ and $R^{19}$ each represents an alkylene group or an oxyalkylene group at the same time to form a heterocyclic ring containing the N, P, or S atom in each formula.

In the formulae (I) and (II), $R^1$ and $R^2$ each represents a hydrogen atom, an alkyl and substituted alkyl group having preferably 1 to 22 carbon atoms in the alkyl moiety, an aryl and a substituted aryl group having preferably 6 to 24 carbon atoms, an aralkyl group having preferably 7 to 22 carbon atoms, an aliphatic acyl group having preferably 2 to 22 carbon atoms, an aromatic acyl group having preferably 7 to 22 carbon atoms, an alkyl sulfonyl group having preferably 1 to 22 carbon atoms, an aryl sulfonyl group having preferably 6 to 24 carbon atoms, and A represents an alkylene or a substituted alkylene group having preferably 1 to 10 carbon atoms.

Examples of substituents of the substituted alkyl group represented by $R^1$ or $R^2$ include a dialkylamino group, a cyclic amino group, an alkoxy group, and an alkylthio group, preferably having from 1 to 10 carbon atoms in each alkyl moiety in the substituents. Examples of substitutents of the substituted aryl group represented by $R^1$ or $R^2$ include dialkylamino groups, cyclic amino groups, alkoxy groups and alkylthio groups, preferably having from 1 to 10 carbon atoms in each alkyl moiety in the substituents, a chlorine atom, a bromine atom, a cyano group, a nitro group and a hydroxyl group. The heterocyclic ring formed by $R^1$ and $R^2$ preferably contains from 4 to 22 carbon atoms, and the heterocyclic ring may further contain an oxygen atom. An alkylene group represented by A preferably contains 1 to 10 carbon atoms. Examples of substituents of the substituted alkylene group represented by A include an alkyl group preferably having 1 to 22 carbon atoms, a substituted alkyl group preferably having 1 to 22 carbon atoms in the alkyl moiety (examples of substituents include an aryl group and an aromatic acyl amino group preferably having 6 to 24 carbon atoms in each aryl moiety, an alkylthio group, an aliphatic acylamino group, a dialkylamino group, and an alkoxy group preferably having 1 to 10 carbon atoms in each alkyl moiety), and an aryl group preferably having 6 to 22 carbon atoms.

In the compounds or complex salts used in the present invention, it is preferred that the total number of carbon atoms in $R^1$ and $R^2$ is in a range of from 8 to 36, and it is preferred that either of $R^1$ and $R^2$ is an acyl group. It is preferred that X is a metal atom selected from calcium, barium, manganese, copper, lithium, titanium, zinc, lead, zirconium, cobalt, nickel, aluminum, cerium, lanthanum, chromium, strontium, vanadium, tin, magnesium, iron and cadmium atom. Metal atoms may have any of their possible valences. Preferable metal atoms are titanium, nickel and cobalt. Examples of the quaternary ammonium cation represented by X include cations represented by the formulae

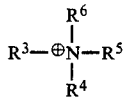

and

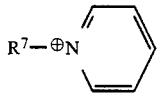

wherein $R^3$, $R^4$, $R^5$, $R^6$ and $R^7$ each represents an alkyl group preferably having from 1 to 18 carbon atoms and an aryl group preferably having from 6 to 24 carbon atoms, and $R^3$, $R^4$, $R^5$, $R^6$ and $R^7$ may be the same or different from each other.

In the following, examples of compounds of the present invention are described, but the present invention is not limited thereto.

Compound 1

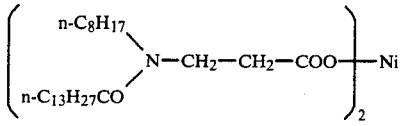

Compound 2

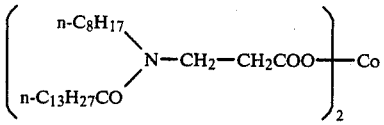

Compound 3

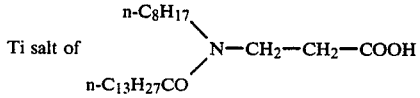

Compound 4

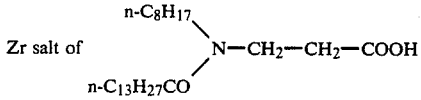

Compound 5

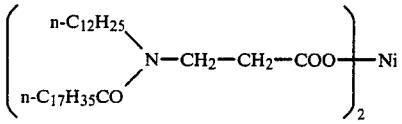

Compound 6

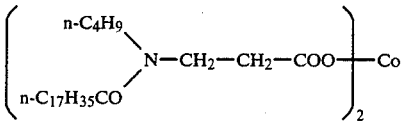

Compound 7

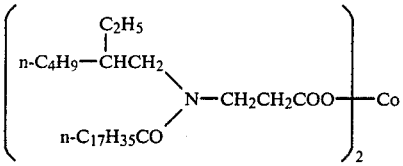

Compound 8

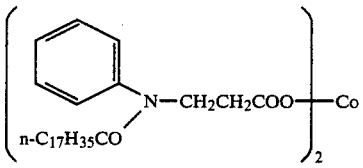

Compound 9

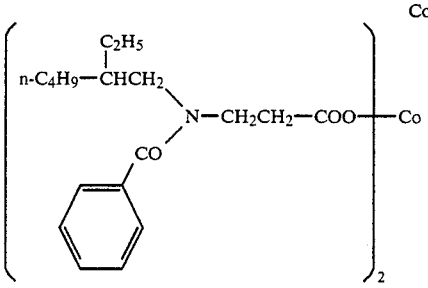

-continued

Compound 10

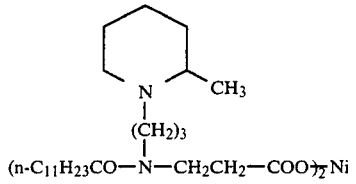

Compound 11

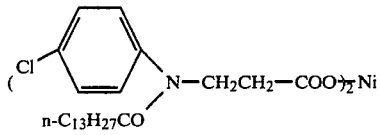

Compound 12 $[(n\text{-}C_8H_{17})_2N-CH_2CH_2-COO\frac{}{2}Ni$

Compound 13 $(n\text{-}C_{16}H_{33}NH-CH_2CH_2COO\frac{}{2}Ni$

Compound 14 $(n\text{-}C_{17}H_{35}CONH-(CH_2)_{10}-COO\frac{}{2}Co$

Compound 15

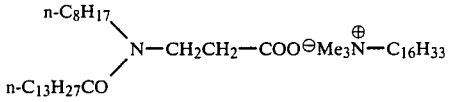

Compound 16 $(n\text{-}C_{17}H_{35}CONH-CH_2CH_2-SO_3\frac{}{2}Co$

Compound 17

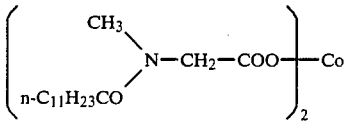

Compound 18

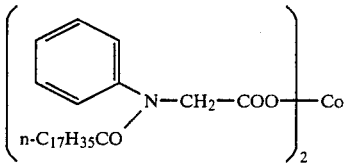

Compound 19

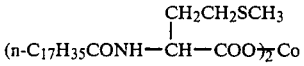

Compound 20

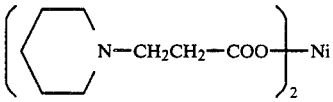

Compound 21

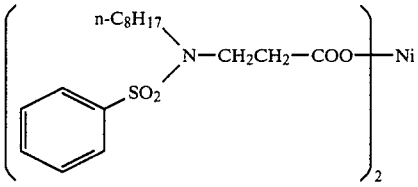

Compound 22

Complex salt of

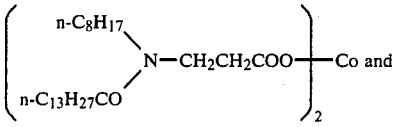

$(CH_3)_2N-CH_2CH_2-N(CH_3)_2$ ligand

As coloring agents used in the present invention, known pigments and dyes used hitherto for liquid developers may be used, either alone or as a combination thereof. For example, there are Hansa Yellow (C.I. 11680), Benzidine Yellow G (C.I. 21090), Benzidine Orange (C.I. 21110), Fast Red (C.I. 37085), Brilliant Carmine 3B (C.I. 16015-Lake), Phthalocyanine Blue (C.I. 74160), Phthalocyanine Green (C.I. 74260), Victoria Blue (C.I. 42595-Lake), Spirit Black (C.I. 50415), Oil Blue (C.I. 74350), Alkali Blue (C.I. 42770A), Fast Scarlet (C.I. 12315), Rhodamine 6B (C.I. 45160), Fast Sky Blue (C.I. 74200 Lake), Nigrosine (C.I. 50415) and carbon black, etc. Pigments, the surface of which is processed, for example, carbon black dyed with Nigrosine and graft carbon grafted with a polymer, etc., can be used, too. In addition, bisarylazo derivatives of 2,3-naphthalenediol as described, e.g., in Japanese Patent Publication No. 195157/82, formazan pigments as described, e.g., in Japanese Patent Publication No. 4440/72, and lake pigments as described, e.g., in Japanese Patent Publication Nos. 1431/76, 4912/81 and 4911/81, etc., can be used.

As the liquid carriers in the present invention, many known materials can be used. It is desirable to use non-aqueous solvents having an electric resistance of $10^9\Omega\cdot$cm or more and a dielectric constant of 3 or less in order not to damage electrostatic images during development. For example, it is possible to use aliphatic hydrocarbons, alicyclic hydrocarbons, aromatic hydrocarbons, halogenated hydrocarbons and polysiloxanes, etc., but it is preferred to use isoparaffin type petroleum solvents in the viewpoint of volatility, safety, virulence, smell, etc. Examples of isoparaffin type petroleum solvents include Isopar G, Isopar H, Isopar L and Isopar K (trade names) produced by Esso Co. and Shell-sol 71 (trade name) produced by Shell Petroleum Co.

In the developers of the present invention, it is possible to incorporate resins which are soluble or swell in the liquid carrier as resins for forming toner particles. These resins have an effect of accelerating dispersion of the coloring agent by adhering to or forming a coating film around the coloring agent and an effect of improving fixation of the developer by acting as a binder for the coloring agent after development processing. As such resins, known many substances can be used. For example, there are rubbers such as butadiene rubber, styrene-butadiene rubber, cyclized rubber and natural rubber, etc., synthetic resins such as styrene resin, vinyltoluene resin, acryl resin, methacryl resin, polyester resin, polycarbonates and polyvinyl acetate, etc., and natural resins such as rosin resin, hydrogenated rosin resin, alkyd resin including modified alkyd resin such as linseed oil modified alkyd resin, etc., and polyterpenes, etc. In addition, phenol resins including modified phenol resin such as phenol-formaldehyde resin, natural resin modified maleic acid resins, pentaerythritol phthalate, chromanindene resins, ester gum resins, vegetable oil polyamides and the like are available. Further, halogenated hydrocarbon polymers such as polyvinyl chloride or chlorinated polypropylene, etc., can be used.

In order to improve the dispersibility of the developers of the present invention, it is possible to use known dispersing agents. As the dispersing agents it is possible to use resins which dissolve or swell in non-aqueous solvents having a high electric resistance used for the developers of the present invention and which are able to improve dispersibility of the toner, for example, synthetic rubbers such as styrene-butadiene rubber, vinyltoluene-butadiene rubber or butadiene-isoprene rubber, etc., polymers of acryl monomers having a long chain alkyl group such as 2-ethylhexyl methacrylate, lauryl methacrylate, stearyl methacrylate, lauryl acrylate or octyl acrylate, etc., copolymers of the above-described acryl monomers and other polymerizable monomers (for example, styrene-lauryl methacrylate copolymer and acrylic acid-lauryl methacrylate copolymer, etc.), polyolefins such as polyethylene, and polyterpenes, etc. In addition, polymers containing quaternary ammonium salt monomers as described, e.g., in Japanese Patent Application (OPI) No. 31739/79 can be used.

In the developers of the present invention, known charge controlling agents can be used in combination with those of the present invention, though they are not always necessary. Suitable examples thereof include metal salts of aliphatic acids such as naphthenic acid, octanoic acid, oleic acid, stearic acid, isostearic acid or lauric acid, etc., metal salts of sulfosuccinic acid esters, oil-soluble metal salts of sulfonic acids as described, e.g., in Japanese Patent Publication No. 556/70 and Japanese Patent Application (OPI) Nos. 37435/77 and 37049/77, metal salts of phosphoric acid esters as described, e.g., in Japanese Patent Publication No. 9594/70, metal salts of abietic acid or hydrogenated abietic acid as described, e.g., in Japanese Patent Publication No. 25666/73, calcium salts of alkylbenzenesulfonic acids as described, e.g., in Japanese Patent Publication No. 2620/80, metal salts of aromatic carboxylic acids or sulfonic acids, as described, e.g., in Japanese Patent Application (OPI) Nos. 107837/77, 38937/77, 90643/82 and 139753/82, nonionic surface active agents such as polyoxyethylated alkylamine, lecithin, oils such as linseed oil, etc., polyvinyl pyrrolidone, organic acid esters of polyhydric alcohols, oil-soluble phenol resins described in Japanese Patent Publication No. 3716/71, phosphoric acid ester type surface active agents described in Japanese Patent Application (OPI) No. 210345/82, and sulfonic acid resins described in Japanese Patent Publication No. 24944/81, etc.

The developers of the present invention can be prepared by known processes. In the following, examples of the process for preparing them are described.

Firstly, a coloring agent comprising pigments or dyes or both of them is blended with the above-described resins to form toner particles in a solvent for said resins by means of a blender such as a ball mill, a roll mill or a paint shaker, etc., and the solvent is removed by heating to obtain a mixture.

Further, the mixture is obtained by reprecipitation by pouring the above-described blended mixture in a liquid which does not dissolve the above-described resins.

Moreover, the mixture is obtained by blending the coloring agent and the resins by means of a blender such as a kneader or a three-roll mill, etc., with heating to a temperature higher than the melting point of the resins, and thereafter cooling them.

The resulting mixture is subjected to wet pulverization together with a dispersing agent after dry pulverization or as it is to obtain a toner concentrated dispersion. The solvent for carrying out wet pulverization may be a liquid carrier itself or may be that prepared by adding from 1 to 20% by weight of a solvent for the above-described resins, such as toluene or acetone, etc., to the liquid carrier.

The resulting toner concentrated dispersion is dispersed in a non-aqueous solvent solution containing the charge controlling agents of the present invention to prepare a liquid developer for electrostatic images. The concentration of toner particles in the developer is not restricted, but it is generally in a range of from 0.01 g to 100 g, and preferably from 0.1 g to 10 g, per liter of the liquid carrier. Addition of the charge controlling agents of the present invention may be carried out by processes other than the above-described process. For instance, they may be added during blending or during wet pulverization, or a combination thereof may be used. The concentration of the charge controlling agents of the present invention is preferred to be controlled so as to be in a range of from 0.001 g to 10 g per liter of the developer in the final state intended for use. More preferably, it is in a range of from 0.01 g to 1 g. The charge controlling agent of the present invention may be used alone or as a combination thereof. When a conventional charge controlling agent is also used in the developer of the present invention, the total amount of charge controlling agent is preferably not more than 10 g per liter of the carrier.

The developers of the present invention can be used for known light-sensitive materials using organic photoconductors or inorganic photoconductors. Further, the developers of the present invention can be used for developing electrostatic images formed by means other than exposing to light, for instance, charging of dielectric materials by a charging needle.

As the organic photoconductors, many known organic photoconductors can be used. Examples thereof are substances as described in *Research Disclosure,* #10938 (1973, May, page 61 and after, the article titled "Electrophotographic Elements, Materials and Process"), etc.

Examples thereof in practical use include electrophotographic light-sensitive materials-comprising poly-N-vinylcarbazole and 2,4,7-trinitrofluoren-9-one (U.S. Pat. No. 3,484,239), materials comprising poly-N-vinylcarbazole sensitized with pyrylium salt dyes (Japanese Patent Publication No. 25658/73), electrophotographic light sensitive materials containing organic pigments as a main component (Japanese Patent Application (OPI) No. 37543/74) and electrophotographic light-sensitive materials containing an eutectic complex composed of a dye and a resin as a main component (Japanese Patent Application (OPI) No. 10735/72), etc.

Examples of inorganic photoconductors that can be used in the present invention include various inorganic compounds disclosed, for example, in R. M. Schaffert, *Electrophotography,* Focal Press (London) (1975), pages 260–374. Examples thereof include zinc oxide, zinc sulfide, cadmium sulfide, selenium, selenium-tellurium alloy, selenium-arsenic alloy, and selenium-tellurium-arsenic alloy, etc.

In the following, processes for synthesizing metal salts of the present invention are illustrated with reference to synthesis examples. Concerning synthesis of acylated amino acids, an acylation reaction of amino acids as described in *J. Am. Chem. Soc.*, Vol. 78, p. 172 (1956) can be used. Synthesis of other amino acids can be carried out by conventional processes. Synthesis of metal salts may be carried out by reacting an alkali metal salt of the aminocarboxylic acid with an inorganic salt of the metal or by directly reacting the amino carboxylic acid or amino sulfonic acid with an organic metal compound (described in Japanese Patent Application (OPI) No. 15154/75, Japanese Patent Publication No. 2952/81 and Japanese Patent Publication No. 9416/83), a metal oxide or a metal hydroxide. The preferable molar ratio of the organic or inorganic metal compound used as a starting material for preparation of the charge controlling agent of the present invention to the compound represented by the formula (III) or (IV) is 0.1 to 3. For synthesizing Ti salts of the present invention it is preferred to use $TiCl_4$ as an inorganic salt and a compound represented by the following formula as an organic metal salt $$R_mTiY_{4-m}$$

wherein R represents an alkyl group, an aralkyl group, and an aryl group, Y represents a halogen or an alkoxy group, m represents 0 or an integer of 1 to 3, and when m is 0, at least one of $Y_4$ represents an alkoxy group.

In the present invention a reaction mixture containing the inorganic or the organic metal compound and the carboxylic or sulfonic amino acid represented by formula (III) or (IV), respectively, which are used as starting materials, may also be used. Such reaction mixture containing the above-described organic titanium compound is especially preferred.

The reaction mixture may not be washed with water, and the solvent used for production of the charge controlling agent of the present invention also may not be removed.

SYNTHESIS EXAMPLE 1

Synthesis of Compound 1

To a mixture of n-octylamine (516 g, 4.0 mols), hydroquinone (200 mg) and methanol (400 ml), acrylic acid (144 g, 2.0 mols) was added dropwise with stirring while cooling with ice. After addition, the mixture was refluxed while heating for 4 hours. After cooled to room temperature, NaOH (80 g, 2.0 mols) was added. The reaction mixture was despersed in 6 liters of acetone, and filtration and drying were carried out to obtain the Na salt of N-n-octyl-β-alanine as white crystals having a melting point (dec.) of 242° C. (349 g Yield: 78%).

The resulting Na salt (223 g, 1.0 mol) was dissolved in 2 liters of water, and myristoyl chloride (246.5 g, 1.0 mol) and an aqueous solution of NaOH (NaOH 50 g, water 500 ml) were added dropwise with stirring at the same time thereto. After conclusion of addition, the mixture was stirred for 1 hour, and thereafter concentrated hydrochloric acid (120 ml) was added thereto. Separated crystals were filtered off and dried. Thus, N-myristoyl-N-n-octyl-β-alanine was obtained as white crystals having a melting point of 47° C. (348 g, yield: 85%). The crystals were recrystallized from acetone to obtain a pure product having a melting point of 58°-59° C.

| | C | H | N |
|---|---|---|---|
| Elementary Analysis Value (%) | 72.79 | 12.02 | 3.34 |
| Calculated as $C_{25}H_{49}N_1O_3$ (%) | 72.94 | 12.00 | 3.40 |

N-myristoyl-N-n-octyl-β-alanine (206 g, 0.5 mol) was dissolved in an aqueous solution (2,000 ml) of NaOH (21.1 g, 0.5 mol). A solution prepared by dissolving $NiCl_2.6H_2O$ (59.4 g, 0.25 mol) in water (200 ml) was added with stirring. After stirring for 1 hour, the mixture was extracted with chloroform (1,000 ml). After the organic layer was dried with $Na_2SO_4$, the solvent was distilled away to obtain Compound 1 as a green viscous oil. This oil was solidified by allowing it to stand (196 g, yield: 89%, melting point 68°-70° C.).

SYNTHESIS EXAMPLE 2

Synthesis of Compound 2

Using $CoCl_2.6H_2O$ instead of $NiCl_2.6H_2O$ in Synthesis Example 1, Co salt of N-myristoyl-N-n-octyl-β-alanine was obtained as reddish violet viscous oil (yield: 91%).

SYNTHESIS EXAMPLE 3

Synthesis of Compound 3

N-myristoyl-N-n-octyl-β-alanine (4.11 g, 0.01 mol) was dissolved in chloroform (100 ml), and a solution of titanium tetrachloride (1.90 g, 0.01 mol) in chloroform (50 ml) was added thereto. Triethylamine (4.04 g, 0.04 mol) was added dropwise while stirring at room temperature. After conclusion of addition, the mixture was stirred for 1 hour under refluxing with heating. After cooling, n-hexane (600 ml) was added. After the separated triethylamine hydrochloride was removed by filtration, the filtrate was concentrated to obtain a viscous oil. After it was dissolved in n-hexane (100 ml), water washing was repeated and the separated organic layer was dried with $Na_2SO_4$. Thereafter, the solvent was distilled away to obtain a mixture containing Compound 3 as a light yellow viscous oil (3.5 g).

SYNTHESIS EXAMPLE 4

Synthesis of Compound 4

Using zirconium tetrachloride instead of titanium tetrachloride in Synthesis Example 3, a mixture containing Compound 4 was obtained as a light yellow viscous oil.

SYNTHESIS EXAMPLE 5

Synthesis of Compound 5

After N-stearoyl-N-n-dodecyl-β-alanine (5.23 g, 0.01 mol) was dispersed in water (1,000 ml), it was dissolved by adding NaOH (0.42 g, 0.01 mol) white heating and stirring. A solution prepared by dissolving $NiCl_2.6H_2O$ (1.19 g, 0.005 mol) in water (100 ml) was added with stirring, and the formed crystals were filtered off, washed with water and dried. Compound 5 was obtained as greenish white crystals having a melting point of 65° C. (4.82 g, yield: 88%).

SYNTHESIS EXAMPLE 6

Synthesis of Compound 6

Using N-stearoyl-N-n-butyl-β-alanine instead of N-stearoyl-N-n-dodecyl-β-alanine in Synthesis Example 5 and $CoCl_2.6H_2O$ instead of $NiCl_2.6H_2O$, Compound 6 was obtained as reddish violet crystals having a melting point of 53°-54° C.

SYNTHESIS EXAMPLE 7

Synthesis of Compound 8

Compound 8 was obtained as reddish violet crystals having a melting point of 67° C. using N-stearoyl-N-phenyl-β-alanine instead of N-stearoyl-N-n-butyl-β-alanine and by carrying out the same procedure as in Synthesis Example 6.

SYNTHESIS EXAMPLE 8

Synthesis of Compound 12

To a mixture of di-n-octylamine (241 g, 1.0 mol), triethylamine (101 g, 1.0 mol), methanol (200 ml) and hydroquinone (100 mg), acrylic acid (72 g, 1.0 mol) was added dropwise with stirring while cooling with water. After conclusion of addition, the mixture was stirred while heating under refluxing for 4 hours. After being allowed to stand at room temperature for a night, an aqueous solution of NaOH (43 g, 50 ml) was added and the mixture was poured into acetone (3,000 ml). The formed white precipitates were filtered off and dried (189.3 g, yield: 57%). The resulting crude product (33.5 g, 1 mol) was dissolved in water (1,000 ml), and an aqueous solution (50 ml) of $NiCl_2.6H_2O$ (11.9 g, 0.05 mol) was added thereto. A dispersion of the resulting oily substance was extracted from chloroform (300 ml) and dried with $Na_2SO_4$. Thereafter, the solvent was distilled away to obtain Compound 12 as a green viscous oil (8.3 g, yield: 24%).

SYNTHESIS EXAMPLE 9

Synthesis of Compound 15

N-myristoyl-N-n-octyl-β-alanine (4.11 g, 0.01 mol) was dissolved in a solution of KOH (0.66 g (content 85%), 0.01 mol) in methanol (100 ml), and cetyltrimethylammonium bromide (3.64 g, 0.1 mol) was added thereto. After stirring at room temperature for 30 minutes, the mixture was extracted by adding water (100 ml) and n-hexane (100 ml). After the organic layer was dried with $Na_2SO_4$, the solvent was distilled away to obtain Compound 15 as a waxy solid (5.32 g, yield: 77%).

SYNTHESIS EXAMPLE 10

Synthesis of Compound 17

Na salt of N-lauroylsarcosine (15.5 g, 0.05 mol) was dissolved in water (200 ml). A solution prepared by dissolving $CoCl_2.6H_2O$ (5.95 g, 0.025 mol) in water (100 ml) was added with stirring. After stirring for 1 hour, the formed crystals were filtered off, washed with water and dried. Crystals having a melting point of 105°-110° C. were obtained in a yield of 14.65 g (yield: 98%).

SYNTHESIS EXAMPLE 11

Synthesis of Compound 18

N-phenylglycine (15.1 g, 0.1 mol) was dissolved in an aqueous solution of NaOH (4.3 g, 100 ml), and stearoyl chloride (30.3 g, 0.1 mol) and an aqueous solution of NaOH (5 g/50 ml) were added dropwise thereto at the same time with stirring while cooling with ice. After stirring for 1 hour, the mixture was neutralized with hydrochloric acid, and the separated crystals were filtered off and dried (10.4 g, yields: 25%). Using the resulting crystals, the same procedure as in Synthesis Example 6 was carried out to obtain Compound 18 as reddish violet crystals having a melting point of 64°-65° C.

SYNTHESIS EXAMPLE 12

N-Myristoyl-N-n-octyl-β-alanine (4.11 g, 0.01 mol) was dispersed in isopropyl alcohol (50 ml), and titanium tetraisopropoxide (2.84 g, 0.01 mol) was added dropwise thereto with stirring at room temperature. After conclusion of addition, the mixture was refluxed while heating for 1 hour. After it was cooled to room temperature, n-hexane (50 ml) was added, and the whole mixture was added to water (100 ml). The separated organic layer was washed with water (50 ml) and then with a saturated solution of salt (50 ml), followed by drying with $Na_2SO_4$. The solvent was distilled away to obtain a light yellow viscous oil (yield: 3.79 g). When this oil was allowed to stand, it became a waxy solid, which had the following physical values.

Elementary Analysis Value: C: 60.82%, H: 10.37%, N: 2.50%.

Residual Ash: 15.6%.

Infrared Absorption Spectra: $\nu c{=}o$, 1730, 1640 (shoulder), 1602, 1560 $cm^{-1}$.

This solid is called Reaction Mixture 1. Although the Reaction Mixture 1 is presumed to have the following structure by elementary analysis, it is understood from infrared absorption spectra that it is a mixture of N-myristoyl-N-n-octyl-β-alanine and Ti salt thereof in a molar ratio of nearly 1:1.

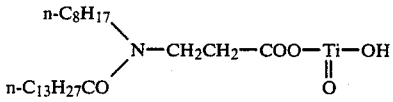

The Reaction Mixture 1 was dispersed in acetone and washing was repeated, by which a powder containing no free acid (Reaction Mixture 2) could be obtained. (In this case, N-myristoyl-N-n-octyl-β-alanine was recovered from washing). The Reaction Mixture 2 had the following physical values.

Melting Point: 217°-219° C.

Elementary Analysis Value: C: 51.83%, H: 8.58%, N: 1.91%.

Residual Ash: 27.0%.

Infrared Absorption spectra: (KBr) $\nu c{=}o$, 1640, 1560 $cm^{-1}$.

It is concluded from these values that Reaction Mixture 2 is Ti salt of N-myristoyl-N-n-octyl-β-alanine containing about 2 equivalents of Ti.

SYNTHESIS EXAMPLE 13

Synthesis of Compound 22 for Comparative Experiment

Compound 2 (4.39 g, 0.005 mol) obtained in Synthesis Example 2 was dissolved in benzene (500 ml) and into the thus-obtained solution N,N,N',N'-tetramethylethylenediamine (0.58 g, 0.005 mol) was added. The color of solution changed from magenta to a little faded reddish tone. After stirring for 1 hour at room temperature the solvent was distilled away, to obtain Compound 22 as a magenta viscous oil in an amount of about the quantitative amount. The infrared spectrum of the compound was different from that of Compound 2 or N,N,N',N'-tetramethylethylenediamine. From the results it is confirmed that a ligand was introduced to Compound 2.

SYNTHESIS EXAMPLE 14

Synthesis of Ti Salt of Myristic Acid for Comparison

Myristic acid (22.8 g, 0.1 mol) was dispersed in isopropyl alcohol (100 ml), and titanium tetraisopropoxide (14.2 g, 0.05 mol) was added thereto dropwise with stirring. After refluxed for 1 hour while heating, the solvent was distilled away. After dispersed in acetone (200 ml), separated crystals were filtered off and dried. It was determined from infrared absorption spectra that the resulting reaction mixture was a mixture of a Ti salt of myristic acid containing a very samll amount of myristic acid.

In the following, the present invention is illustrated in greater detail with examples, but the present invention is not limited thereto. Methods of measurement used in examples are as follows.

(1) Determination of Polarity of Charges

A polyester film having a thickness of about 25μ is put on a comb-like electrode to which direct current of 1 kv is applied. The developer is applied onto it. The determination is carried out by the fact that the toner having negative charges adheres to the positive pole and the toner having positive charges adheres to the negative pole.

(2) Measurement of Amount of Charges

Figure 2:
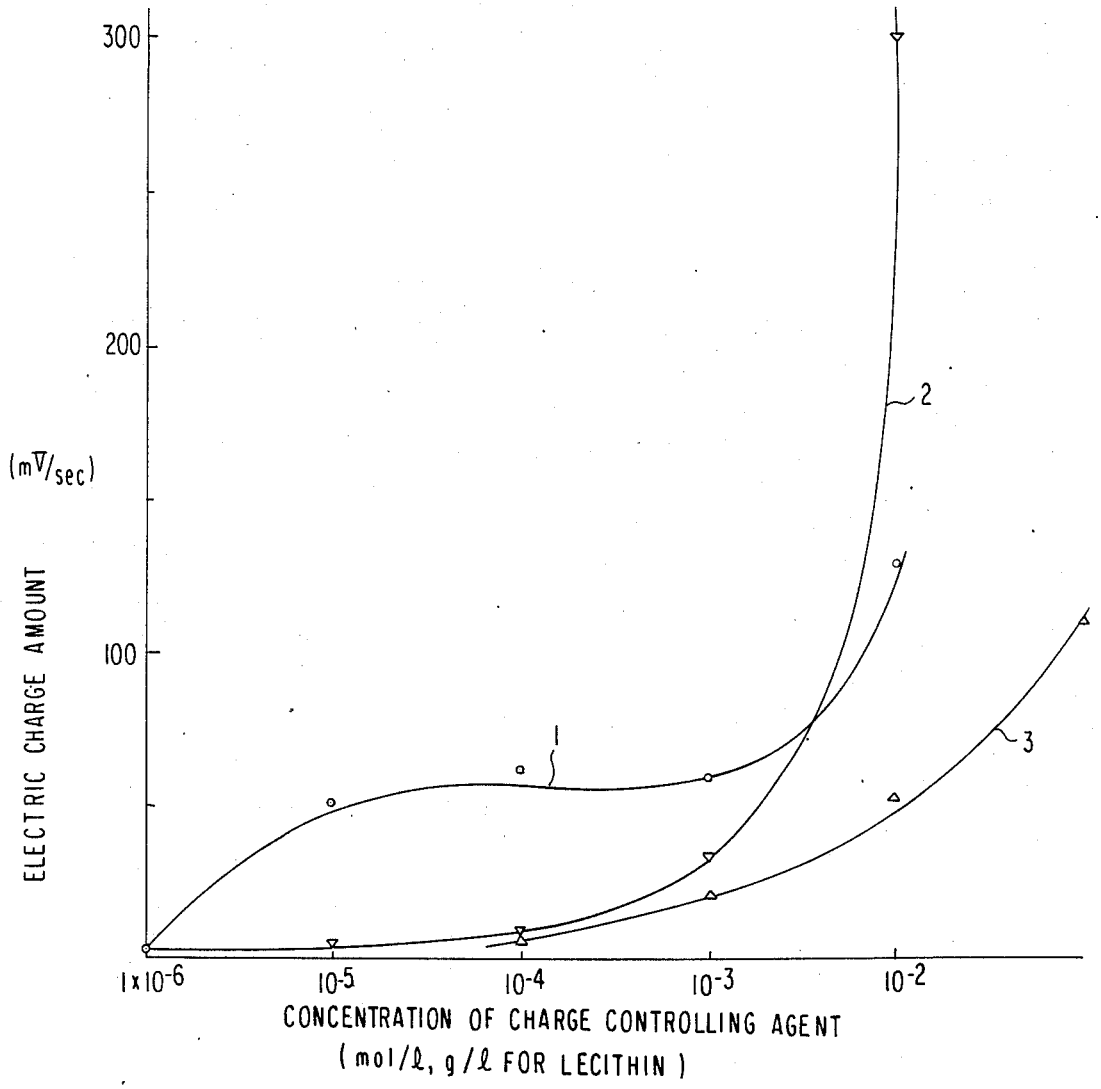
FIG. 2 is a graph which shows a relation between concentration of the charge controlling agent and the amount of electric charge.

Measurement is carried out by the process and the apparatus disclosed in Japanese Patent Application (OPI) No. 58176/82. Namely, the toner is inserted into a condenser formed by parallel electrode plates as shown in FIG. 1. In FIG. 1, 1, 2 and 3 show electrode, 4 shows electric source, 5 and 6 show electric insulator, 7 shows voltmeter, SW-1 and SW-2 show switch, and R shows resistance. After the condenser is electrically charged for a short time, the decay rate of the surface charge is measured, by which measurement can be carried out in a state approaching that of the actual development. The value to be measured is a decay rate of surface charge (mV/sec), which corresponds to the amount of charge on the toner. The conditions of measurement are shown in the following.

Conditions for Measuring the Amount of Charge:
The surface area of each electrode: 9 $cm^2$,
the interval between electrodes 1 and 2: 1.8 mm,
the interval between electrodes 2 and 3: 25μ,
and the capacity between the electrodes: 1200 PF,
the voltage of the electric sourceβ: 500 v, and
resistance R=50 K Ω.

(3) Measurement of Rate of Ion Components

The value obtained by measuring the amount of charges is the sum of an amount of charges on toner particles and ion components contained in the developer. It has been known that ion components have a great influence upon development characteristics. Therefore, a rate of the measured value of a liquid toner obtained by centrifugally removing toner particles to the measured value of the original toner is shown as %. The lower this rate is, the smaller the degree of smearing of images is. Further, destruction of electrostatic images is lessened, and the running aptitude is better.

EXAMPLE 1

| | part by weight |
|---|---|
| Carbon Black (#40, produced by Mitsubishi Chemical Industries, Ltd.) | 1 |
| Solprene 1205 (trade name of styrene-butadiene copolymer, produced by Asahi Chemical Industry Co., Ltd.) | 1 |
| Isopar H | 23 |

The above-described liquid composition was blended for 90 minutes in a paint shaker (produced by Toyo Seiki Co.) together with 20 parts by weight of glass beads to obtain a concentrated dispersion toner. It was then diluted with solutions of Compound 1 in Isopar H having concentrations of $10^{-6}$, $10^{-5}$, $10^{-4}$, $10^{-3}$ and $10^{-2}$ mol/l, respectively, to obtain developers. The solid content in the developers was controlled so as to be 0.25 g/l.) When amounts of charges were measured by means of an apparatus shown in FIG. 1 after the developers were allowed to stand for 2 days, they showed nearly stabilized amounts of charges over a wide range of $10^{-3}$ to $10^{-5}$ mol/l as shown by curve 1 in FIG. 2. When the same measurement was carried out using zirconium naphthenate or soybean lecithin for comparison instead of Compound 1, the range of obtaining stabilized charges was very narrow as shown by curves 2 and 3, respectively, in FIG. 2 and the amount of the charge controlling agent to be added was subject to very narrow restriction.

EXAMPLE 2

| | part by weight |
|---|---|
| Carbon Black (#40, produced by Mitsubishi Chemical Industries, Ltd.) | 1 |
| Solprene 303 (trade name of styrene-butadiene copolymer, produced by Asahi Chemical Industry Co., Ltd.) | 2 |
| Toluene | 20 |

The above-described liquid composition was processed for dispersing by a ball mill for a whole day and night. The mixture was poured into Isopar H (produced by Esso Co.) and the precipitate was filtered off. It was blended with a solution prepared by dissolving 2 parts by weight of Solprene 1205 (styrene-butadiene copolymer, produced by Asahi Chemical Industry Co.) in 40 parts by weight of Isopar H, and the mixture was processed by a ball mill for 3 days to obtain a concentrated dispersion toner. When the average particle size was measured by a Nano-Sizer (produced by Coulter Electronics Co.), it was 0.38μ.

Using solutions prepared by dissolving compounds of the present invention shown in Synthesis Examples in Isopar H so as to have a concentration of $1\times10^{-4}$ mol/l, the resulting concentrated dispersion toner was diluted to obtain developers having negative charges. The solid content in the developers was controlled so as to be 1 g/l. Then, the amount of charges and the rate of ion components in each compound were measured. Results are shown in Table 1.

TABLE 1

| Charge Controlling Agent | Amount of Charges (mV/sec.) | Rate of Ion Components (%) |
|---|---|---|
| Compound 1 | 168.7 | 2.2 |
| Compound 2 | 164.1 | 9.4 |
| Mixture of Compound 3 (0.049 g/l) | 171.4 | 8.4 |
| Mixture of Compound 4 (0.053 g/l) | 155.4 | 5.6 |
| Compound 5 | 162.1 | 6.9 |
| Compound 6 | 125.6 | 8.2 |
| Compound 8 | 138.2 | 7.8 |
| Compound 12 | 148.7 | 2.2 |
| Compound 15 | 143.5 | 5.9 |
| Compound 17 | 96.2 | 4.5 |
| Compound 18 | 115.4 | 3.7 |
| Comparative Example Zirconium Naphthenate ($1 \times 10^{-4}$ mol/l) | 28.5 | 21.4 |
| Comparative Example Soybean Lecithin ($1 \times 10^{-3}$ g/l) | 43.4 | 9.9 |

Then, a solution prepared by dissolving 100 parts by weight of poly-N-vinylcarbazole (PVCz), 5 parts by weight of vinylidene chloride-acrylonitrile copolymer, 3 parts by weight of styrene-butadiene copolymer, and 2,6-di-t-butyl-4-[4-(N,N-dichloroethylamino)styryl]-thiapyrylium tetrafluoroborate in 2,000 ml of 1,2-dicyhloroethane was applied to a polyethylene terephthalate (PET) film having a thickness of 100 μm which has an $In_2O_3$ vacuum evaporation layer having a thickness of 60 nm ($In_2O_3$ electroconductive PET film). Thereafter, the solvent was removed by drying to form a photoconductive layer having a thickness of 5 μm. Thus, an electrophotographic film was produced.

The surface of this film was electrically charged at +350 v, and it was imagewise exposed to light through a positive original to form an electrostatic latent image.

When this electrostatic latent image was developed with the above-described developers, an image having excellent resolving power, good halftone reproduction, and excellent gradiation was obtained in the case of using the compounds of the present invention.

When the same development processing was carried out for comparison for adding $1 \times 10^{-4}$ mol/l of zirconium naphthenate as the charge controlling agent instead of the compound of the present invention in Example 2, smearing of images and formation of fringed images occurred to a significant extent, and only obscure images were obtained.

In the case of using soybean lecithin, the image forming property remarkably deteriorated with the passage of time.

When the degree of dispersion was observed after the developer containing Compound 2 was allowed to stand at room temperature for 6 months, a very small amount of precipitates was formed, which was easily redispersed by shaking. When the particle size was measured under such a state, it was not different from that before 6 months. The image obtained by development using this developer was excellent.

EXAMPLE 3

An available zinc oxide light-sensitive paper (BS paper, produced by Ricoh Co.) as a light-sensitive material was electrically charged by corona discharging at −6 kv and imagewise exposed to light. When it was subjected to reversal development processing using a developer prepared by adding $5 \times 10^{-5}$ mol/l of Compound 1 as a charge controlling agent in Example 2, a clearcut reversal image was obtained.

EXAMPLE 4

| | part by weight |
|---|---|
| Carbon Black (#40, produced by Mitsubishi Chemical Industries, Ltd.) | 3.5 |
| n-Butyl methacrylate-Vinyltoluene Copolymer (molar ratio: 1:1) | 3.5 |
| Alkali Blue | 0.7 |
| Toluene | 17 |

After the above-described composition was dispersed, the solvent was distilled away to obtain a lump composed of the pigment and the resin. After it was roughly ground, 1 part by weight of it was subjected to the same procedure as in Example 1 to obtain a concentrated dispersion toner. It was diluted with Isopar G containing $10^{-4}$ mol/l of Compound 3 to obtain a developer. When an electrophotographic film shown in Example 2 was developed using the developer, a clearcut pure black image was obtained.

EXAMPLE 5

| | part by weight |
|---|---|
| Carbon Black (#40, produced by Mitsubishi Chemical Industries, Ltd.) | 1 |
| n-Stearyl Methacrylate-Methyl Methacrylate Copolymer (molar ratio: 1:9) | 2 |

The above-described mixture was kneaded by a 3-roll mill heated to 140° C. After cooled, it was roughly ground to obtain a mixture composed of the pigment and the resin. 1 part by weight of it was subjected to the same procedure as in Example 1 to obtain a concentrated toner. It was diluted with the following liquid composition to obtain a developer.

Compound 1: $1 \times 10^{-4}$ mol/l

2% Solution of Chlorinated Polypropylene in Toluene: 15 g/l

Acrylic Acid-n-Lauryl Methacrylate Copolymer (molar ratio: 85:15): 0.12 g/l

Isopar G

When 2,000 sheets were continuously developed with 300 ml of the developer using an original test pattern having an image area of 0.65 $cm^2$ and a blackening rate of 20% after the development condition was controlled so as to be Dmax 1.50, deterioration of Dmax and resolving power were not observed.

EXAMPLE 6

| | part by weight |
|---|---|
| Carbon Black (#40, produced by Mitsubishi Chemical Industries, Ltd.) | 3.5 |
| n-Butyl Methacrylate-Aminomethylstyrene Copolymer (molar ratio: 7:3) | 3.5 |
| Toluene | 17 |

The above-described mixture was blended in a paint shaker for 90 minutes together with 70 parts by weight of glass beads. The mixture excluding glass beads was poured into Isopar H, and the precipitate was filtered off. The separated precipitate was blended with a solution of Solprene 1205 in Isopar H (5% by weight, 70 parts by weight), and the mixture was blended in a paint shaker for 90 minutes together with 90 parts by weight of glass beads to obtain a concentrated toner. It was diluted with a solution containing $10^{-4}$ mol/l of Compound 1 in Isopar H to obtain a developer having positive charges. When a light-sensitive paper used in Example 4 was positively developed with the developer, a clear-cut positive image was obtained.

EXAMPLE 7

When a commercially available transparent electrophotographic film (EKTAVOLT SO-102, produced by Eastman Kodak Co.) used as a light-sensitive material was developed with the developer in Example 4 after it was electrically charged at +350 v and imagewise exposed to light, a clear-cut pure black image showing a resolving power of 130/mm was obtained.

Further, when an electrophotographic film used for A. B. Dick/Scott System 200 produced by Jamse Liver Co. was used as a light-sensitive material, a similar result was obtained.

EXAMPLE 8

| | part by weight |
|---|---|
| Carbon Black (#40, produced by Mitsubishi Chemical Industries, Ltd.) | 1 |
| n-Butyl Methacrylate-Methyl Methacrylate Copolymer (molar ratio: 3:7) | 2 |

Using the above-described mixture, the same procedure as in Exámple 5 was carried out to obtain a concentrated toner. It was then diluted with solutions prepared by dissolving reaction mixtures synthesized in Synthesis Example 12 and Synthesis Example 14 in Insopar G to obtain developers. Charging characteristics thereof are shown in Table 2.

TABLE 2

| Charge Controlling Agent (concentration) | Polarity of Charges | Amount of Charges (mV/sec) | Rate of Ion Components |
|---|---|---|---|
| Reaction Mixture 1 in Synthesis Example 12 (0.05 g/l) | − | 58.5 | 27.2 |
| Reaction Mixture 2 in Synthesis Example 12 (0.025 g/l) | − | 25.0 | 50 |
| Reaction Mixture in Synthesis Example 14 (0.1 g/l) | ± | 2.2 | — |

When electrophotographic films shown in Examples 2 and 7 were electrically cahrged, exposed to light and developed with the developer containing the Reaction Mixture 1, good images were obtained, and the non-smearing characteristics of the images were remarkably improved. Further, a similar result was obtained in the case of using the developer containing the Reaction Mixture 2. In the case of using the developer containing the reaction mixture in Synthesis Example 14, only an obscure image similar to reversed image was obtained, because the polarity of the charges was not clear.

EXAMPLE 9

A liquid developer was prepared by diluting the concentrated toner obtained in Example 5 with Isopar containing Compound 22 obtained in Synthesis Example 13 in an amount of $10^{-4}$ mol/l to obtain a liquid developer.

Developing processing was conducted in the same manner as in Example 8. A sharp image was obtained.

Deterioration of the liquid developer was extremely small under a condition of a high temperature and a high humidity.

While the invention has been described in detail and with reference to specific embodiments thereof, it wll be apparent to one skilled in the art that various changes and modifications can be made therein without departing from the spirit and scope thereof.

What is claimed is:

1. A liquid developer for electrostatic images which comprises a liquid carrier having an electric resistance of at least $10^9$ Ω·cm and a dielectric constant of not more than 3 and at least one negative charge controlling agent selected from the group consisting of compounds represented by formula (I) or (II) and complex salts containing a molecular structure shown by the formula (I) or (II):

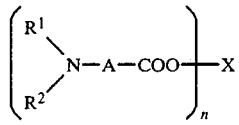

(I)

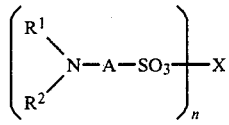

(II)

wherein $R^1$ and $R^2$ each represents a hyrogen atom, an alkyl and substituted alkyl group, and aryl and a substituted aryl group, an aralkyl group, an aliphatic acyl group, and aromatic acyl group, an alkylsulfonyl group, an arylsulfonyl group, $R^1$ and $R^2$ represent identical group or different groups, or $R^1$ and $R^2$ together form a heterocyclic ring with the nitrogen atom in the formulae, and when one of $R^1$ and $R^2$ represents an hydrogen atom, the other represents a group other than a hydrogen atom;

A represents an alkylene group or a substituted alkylene group;

X represents a hydrogen atom, a monovalent to tetravalent metal atom, a quarternary ammonium cation, and n represents a positive integer of 1 to 4, and when X represents the metal atom defined above and the number represented by n is not sufficient to satisfy the valence of the metal atom represented by X, the residual metal valence bond or bonds are occupied with one or more ligands to form the complex salt containing a molecular structure shown by the formula (I) or (II), said charge controlling agent being dissolved in said liquid carrier.

2. A liquid developer for electrostatic images as in claim 1, wherein said substituted alkyl group represented by $R^1$ or $R^2$ has a substituent selected from the group consisting of a dialkylamino group, a cyclic amino group, an alkoxy group, and an alkylthio group.

3. A liquid developer for electrostatic images as in claim 1, wherein said substituted aryl group represented by $R^1$ or $R^2$ has a substituent selected from the group consisting of a dialkylamino group, a cyclic amino group, an alkoxy group, an alkylthio group, a chlorine atom, a bromine atom, a cyano group, a nitro group, and a hydroxyl group.

4. A liquid developer for electrostatic images as in claim 1, wherein said heterocyclic ring formed by $R^1$ and $R^2$ contains an oxygen atom.

5. A liquid developer for electrostatic images as in claim 1, wherein said substituted alkylene group represented by A contains a substituent selected from the group consisting of an alkyl group, a substituted alkyl group and an aryl group.

6. A liquid developer for electrostatic images as in claim 5, wherein said substituted alkyl group has a substituent selected from the group consisting of an aryl group, aromatic acylamino group, an alkylthio group, an aliphatic acylamino group, a dialkylamino group, and an alkoxy group.

7. A liquid developer for electrostatic images as in claim 1, wherein the total number of carbon atoms in $R^1$ and $R^2$ is in a range of from 8 to 36.

8. A liquid developer for electrostatic images as in claim 1, wherein said metal atom is selected from the group consisting of calcium, barium, manganese, copper, lithium, titanium, zinc, lead, zirconium, cobalt, nickel, aluminum, cerium, lanthanum, chromium, strontium, vanadium, tin, magnesium, iron and cadmium.

9. A liquid developer for electrostatic images as in claim 1, wherein said metal atom is selected from the group consisting of cobalt, nickel and titanium.

10. A liquid developer for electrostatic images as in claim 1, wherein said quarternary ammonium cation represented by X is selected from the group consisting of groups represented by the following formulae

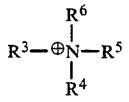

and

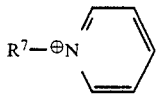

wherein said $R^3$, $R^4$, $R^5$, $R^6$and $R^7$ each represents an alkyl group and an aryl group.

11. A liquid developer for electrostatic images as in claim 1, wherein said ligand is selected from the group consisting of halogens, a hydroxyl group, an oxygen atom, water, ammonia, amines, phosphines, and sulfides.

12. A liquid developer for electrostatic images as in claim 1, wherein said charge controlling agent is selected from the group consisting of compounds represented by the following formulae

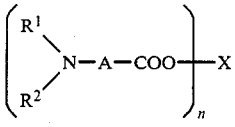

and

-continued

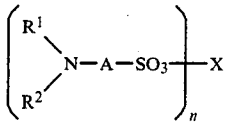

wherein the valence of X is the same as the number represented by n.

13. A liquid developer for electrostatic images as in claim 1, wherein the number represented by n does not show a sufficient number of acid residue of formula (I) or (II) to satisfy the valence of the metal represented by X, and the residual velence bond or bonds of the metal are occupied by one or more ligands to form a complex salt containing a molecular structure shown by the general formula (I) or (II).

14. A liquid developer for electrostatic images as in claim 13, wherein said ligand is selected from the group consisting of compounds represented by the following formulae

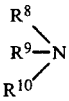

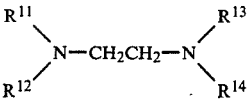

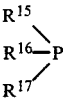

and

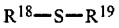

wherein $R^8$, $R^9$, $R^{10}$, $R^{11}$, $R^{12}$, $R^{13}$, $R^{14}$, $R^{15}$, $R^{16}$, $R^{17}$, $R^{18}$ and $R^{19}$ each represents a hydrogen atom, an alkyl group or an aryl group, provided that in each formula $R^{15}$, $R^{16}$ and $R^{17}$, $R^{18}$ and $R^{19}$ do not all represent hydrogen atoms at the same time; or in each combination of two groups among $R^8$, $R^9$ and $R^{10}$, $R^{11}$ and $R^{12}$, $R^{13}$ and $R^{14}$, two groups among $R^{15}$, $R^{16}$ and $R^{17}$, and $R^{18}$ and $R^{19}$ each group represents an alkylene group or an oxyalkylene group to form a heterocyclic ring containing an N, P, or S atom in each formula.

15. A liquid developer for electrostatic images as in claim 1, wherein said charge controlling agent is used in a state of a reaction mixture produced by reacting an inorganic or organic metal salt and at least one compound represented by the formulae

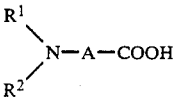

and

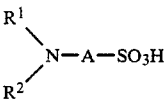

wherein definitions of $R^1$, $R^2$ and A are the same as in claim 1.

16. A liquid developer for electrostatic images as in claim 15, wherein said inorganic metal salt is selected from titanium salts and zirconium salts.

17. A liquid developer for electrostatic images as in claim 15, wherein said organic metal salt is a compound represented by the formula $$R_mTiY_{4-m}$$

wherein R represents an alkyl group, an aralkyl group, and an aryl group, Y represents a halogen or an alkoxy group, m represents 0 or an integer of 1 to 3, and when m is 0, at least one of $Y_4$ represents an alkoxy group.

18. A liquid developer for electrostatic images as in claim 15, wherein said inorganic salt is $TiCl_4$.

19. A liquid developer for electrostatic images as in claim 1, wherein the developer comprises a liquid carrier and from 0.01 g to 100 g of toner particles per liter of the liquid carrier.

20. A liquid developer for electrostatic images as in claim 1, wherein the charge controlling agent is contained in an amount of from 0.001 g to 10 g per liter of the developer in a final state of using.

21. A liquid developer for electrostatic images as in claim 1, wherein said liquid developer is a negatively charged developer.

* * * * *